US010946993B2

(12) United States Patent
Jensen et al.

(10) Patent No.: US 10,946,993 B2
(45) Date of Patent: Mar. 16, 2021

(54) WRAPPING DEVICE FOR A MACHINE FOR WINDING-UP A WEB MATERIAL, AND A MACHINE FOR WINDING-UP A WEB MATERIAL INCLUDING THE WRAPPING DEVICE

(71) Applicant: Roll-O-Matic A/S, Vissenbjerg (DK)

(72) Inventors: John Buk Jensen, Munkebo (DK); Mads Sandahl Christensen, Tommerup (DK)

(73) Assignee: ROLL-O-MATIC A/S, Vissenbjerg (DK)

( * ) Notice: Subject to any disclaimer, the term of this patent is extended or adjusted under 35 U.S.C. 154(b) by 0 days.

(21) Appl. No.: 16/341,850

(22) PCT Filed: Oct. 11, 2017

(86) PCT No.: PCT/EP2017/075961
§ 371 (c)(1),
(2) Date: Apr. 12, 2019

(87) PCT Pub. No.: WO2018/069404
PCT Pub. Date: Apr. 19, 2018

(65) Prior Publication Data

US 2019/0315503 A1 Oct. 17, 2019

(30) Foreign Application Priority Data

Oct. 14, 2016 (DK) ..... PA 2016 70809

(51) Int. Cl.
*B65B 13/02* (2006.01)
*B65C 3/02* (2006.01)
(Continued)

(52) U.S. Cl.
CPC ..... *B65B 13/02* (2013.01); *B65C 3/02* (2013.01); *B65B 35/22* (2013.01); *B65B 35/26* (2013.01); *B65C 9/06* (2013.01); *B65C 9/18* (2013.01)

(58) Field of Classification Search
CPC ..... B65B 13/02; B65B 35/22; B65C 3/02; B65C 9/06
(Continued)

(56) References Cited

U.S. PATENT DOCUMENTS 4,269,557 A 5/1981 Kidd
4,277,032 A * 7/1981 Alberto ..... B65H 19/2238 242/419.8
(Continued)

FOREIGN PATENT DOCUMENTS

CH 489419 A 6/1970
DE 60219482 T2 12/2007
(Continued)

OTHER PUBLICATIONS

International Search Report and Written Opinion for PCT/EP2017/075961, dated Jan. 16, 2018.
(Continued)

*Primary Examiner* — Gene O Crawford
*Assistant Examiner* — Lester Rushin, III
(74) *Attorney, Agent, or Firm* — Brinks Gilson & Lione; John C. Freeman

(57) ABSTRACT

The invention relates to a wrapping device (300) for wrapping a band around a wound up roll (5"), characterised in:—a storage (301) for said band (303) to be wrapped around said wound up roll (5"),—a first conveyor (330) positionable adjacent said wound roll (5"), for conveying said band (303) to said roll (5"),—said first conveyor (330) comprising a cylindrical drum configured for rotation about
(Continued)

an axis (W),—said drum (330) having a surface configured for receiving and transferring said band (303) to said wound up roll (5") by a vacuum applied to said band (303) via apertures (331) formed in said surface.

19 Claims, 13 Drawing Sheets

(51) Int. Cl.

| | |
|---|---|
| ***B65B 35/22*** | (2006.01) |
| ***B65C 9/18*** | (2006.01) |
| *B65B 35/26* | (2006.01) |
| *B65C 9/06* | (2006.01) |

(58) Field of Classification Search
USPC ..... 198/347.1; 156/363
See application file for complete search history.

(56) References Cited

U.S. PATENT DOCUMENTS

| | | | | |
|---|---|---|---|---|
| 4,336,813 | A | 6/1982 | Seragnoli | |
| 4,435,246 | A * | 3/1984 | Green | B65C 1/021 156/363 |
| 5,588,644 | A | 12/1996 | Lotto et al. | |
| 6,253,983 | B1 * | 7/2001 | Dadd | B65H 20/10 162/193 |
| 6,378,587 | B1 | 4/2002 | Frist | |
| 6,427,941 | B1 | 8/2002 | Hikita | |
| 6,450,230 | B1 * | 9/2002 | Otruba | B65C 9/1807 156/542 |
| 7,654,427 | B1 | 2/2010 | Tsai et al. | |
| 2004/0250706 | A1 | 12/2004 | De Matteis | |
| 2015/0068372 | A1 | 3/2015 | Abney et al. | |

FOREIGN PATENT DOCUMENTS

| | | | |
|---|---|---|---|
| EP | 2013041100 | A1 | 3/2013 |
| EP | 2 612 632 | A1 | 7/2013 |
| WO | WO 96/26112 | A1 | 8/1996 |
| WO | 2016150946 | A1 | 9/2016 |
| WO | WO 2016/150946 | A1 | 9/2016 |

OTHER PUBLICATIONS

Search Report dated Apr. 11, 2017 (four pages—foreign text) from Denmark priority, Application PA 2016 70809.
International Preliminary Report on Patentability dated Apr. 16, 2019 from corresponding PCT Application No. PCT/EP2017/075961 (7 pages).

* cited by examiner

WRAPPING DEVICE FOR A MACHINE FOR WINDING-UP A WEB MATERIAL, AND A MACHINE FOR WINDING-UP A WEB MATERIAL INCLUDING THE WRAPPING DEVICE

RELATED APPLICATIONS

This application claims the benefit under 35 U.S.C. § 371 of the filing date of International Patent Application No. PCT/EP2017/075961, having an international filing date of Oct. 11, 2017, which claims priority to Danish Application No. PA 2016 70809, filed Oct. 14, 2016, the contents of both of which are incorporated herein by reference in their entirety.

FIELD OF THE INVENTION

The present invention relates to a wrapping device suitable for the production of wrapped rolls, coreless or with a core, comprising a plurality of bags or the like items, which bags, as the case may be, may be presented to the end-user in an individualized and interleaved form.

BACKGROUND OF THE INVENTION

Plastic bags are often wound up into a roll. The type of bags most typically found in a rolled up form, in particular as a coreless roll, are bags known as freezing bags, trash bags or garbage bags.

It is known to provide a windup apparatus wherein a turret style winder is used to make such rolls of bags. The turret has a plurality of spindles together with means for indexing individual spindles into the path of the advancing stream of overlapped or interleaved bags. Additionally, the spindles may be provided with apertures through which vacuum is drawn for gripping the leading edge of each first bag, together with means for reversing the vacuum into positive air pressure, upon indexing of individual spindles with completed rolls out of the path of the advancing interleaved bags, as well as means for pushing a completed roll off a pressurized spindle.

WO 2016/150946 discloses a winding up apparatus having a wrapping device at one end thereof and wherein wound up rolls held on a spindle rotating in one direction about its longitudinal axis are moved to a dedicated work station, for applying a wrapping around each of the finished rolls, to prevent the finished rolls from unwinding. Normally the wrappings will be in the form of respective elongated bands, often strips of paper serving the function of a label, carrying an adhesive and having a length slightly longer than the circumference of the roll to allow the bands to reach around the roll.

In an even simpler form, winding apparatuses for which the present wrapping device is useful may comprise a single rotatable spindle, without a rotatable turret, wherein the wrapping device may be moved into position next to the spindle carrying the roll, for wrapping a band around the roll.

BRIEF SUMMARY OF THE INVENTION

The object of the present invention is to provide an improved wrapping device of the type mentioned above. To this aim the wrapping device is preferably arranged to define a dedicated work station for wrapping and generally includes a storage for the band to be wrapped around a wound up roll, a first conveyor positioned adjacent the wound up roll, for conveying the band to the roll, the first conveyor comprising a cylindrical drum configured for rotation about an axis parallel with the axis of rotation of the spindle carrying the roll and located at the dedicated work station, the drum having a surface configured for receiving and transferring the band to the wound up roll by a vacuum applied to the band via apertures formed in the surface.

With the invention it is achieved that a band defining the wrapping and carrying an adhesive for adhering to the surface of the roll is conveyed to the roll in a position with the adhesive facing away from the surface of the cylindrical drum, and the face carrying the adhesive is then brought into contact with the surface of the roll, for adhering the band to the roll. Hence, it may conveniently be avoided that that any major surfaces of the wrapping device, including in particular the conveyors for advancing the bands to the rolls, will contact the adhesive.

In particular, in one embodiment of the invention the drum is configured for progressively releasing the vacuum applied to the band as it is transferred to the wound up roll on rotating the drum, wherein the drum includes a core surrounded by a tubular casing defining the surface of the drum, a drive rotating the tubular casing relative to the core, wherein only some of the apertures apply the vacuum at a given time, application of the vacuum being controlled by rotation of the tubular casing relative to the core.

By incorporating a column to which the first conveyer is displaceably mounted, as well as a second conveyor supplying the wrapping material to the first conveyor, is it possible to allow for easy access to the winding up apparatus for maintenance.

An embodiment of the invention will now be described, by way of example only, with reference to the accompanying drawings and in the context of a winding apparatus as disclosed in WO 2016/150946.

FIG. 1*a* is a longitudinal perspective and schematic cross-sectional view of a prior art machine 1 for processing a flat web, FIG. 1*b* shows the machine of FIG. 1*a* incorporating the wrapping device of the present invention, FIG. 2 shows an end view of the machine of FIGS. 1*a* and *b*, as seen to the left in FIGS. 1*a* and 1*b*, with the end wall and wrapping device removed and in one operating state, FIGS. 3*a* and 3*b* show perspective views of a machine part for winding of rolls, with all other parts of the machine of FIGS. 1*a* and 1*b* removed, and illustrating spindles in retracted and advanced positions, FIG. 4 is a view similar to FIG. 2 showing the machine part in another operating state wherein a finished roll is leaving a spindle, FIGS. 5*a* and 5*b* are views similar to FIGS. 3*a* and 3*b*, showing a basic configuration of the machine part for winding up rolls, with some elements removed, FIG. 5*c* is a view similar to FIG. 5*b* and showing in addition a sled drive, FIGS. 6*a* and 6*b* are views showing a spindle unit supported by a spindle support in extended and retracted position, respectively (cross-section), FIG. 7 is a view showing a portion of the machine as viewed towards a side, illustrating the discharge of finished rolls, FIGS. 8*a* and 8*b* show details relating to the brushes for initiating roll-up, FIG. 9 is a perspective front view of the wrapping device shown in FIG. 1*b*

FIG. 10 shows a wrapping unit being a part of the wrapping device of FIG. 9, FIG. 11 shows a lower part of the wrapping device with the wrapping unit, in the process of transferring a band from to a first conveyor, and FIG. 12 is a sectional view showing the inside structure of the first conveyor, and with the band shown in FIG. 11 being transferred to a roll.

The shown machine 1 also includes a machine part referenced generally by numeral 20 (shown only in part in FIG. 1*a*) and highly suitable for making coreless rolls 5 comprising a number of the aforementioned individualized sections of the web. Alternatively, the rolls 5 may comprise an integral length of the web presenting cross-wise perforations, requiring an end-user to do the individualization himself, this length of the web having been separated from adjoining lengths of the web by the aforementioned separator mechanism. The rolls 5 may by way of example have a diameter in the order of 3 cm-15 cm.

Figure 1A:
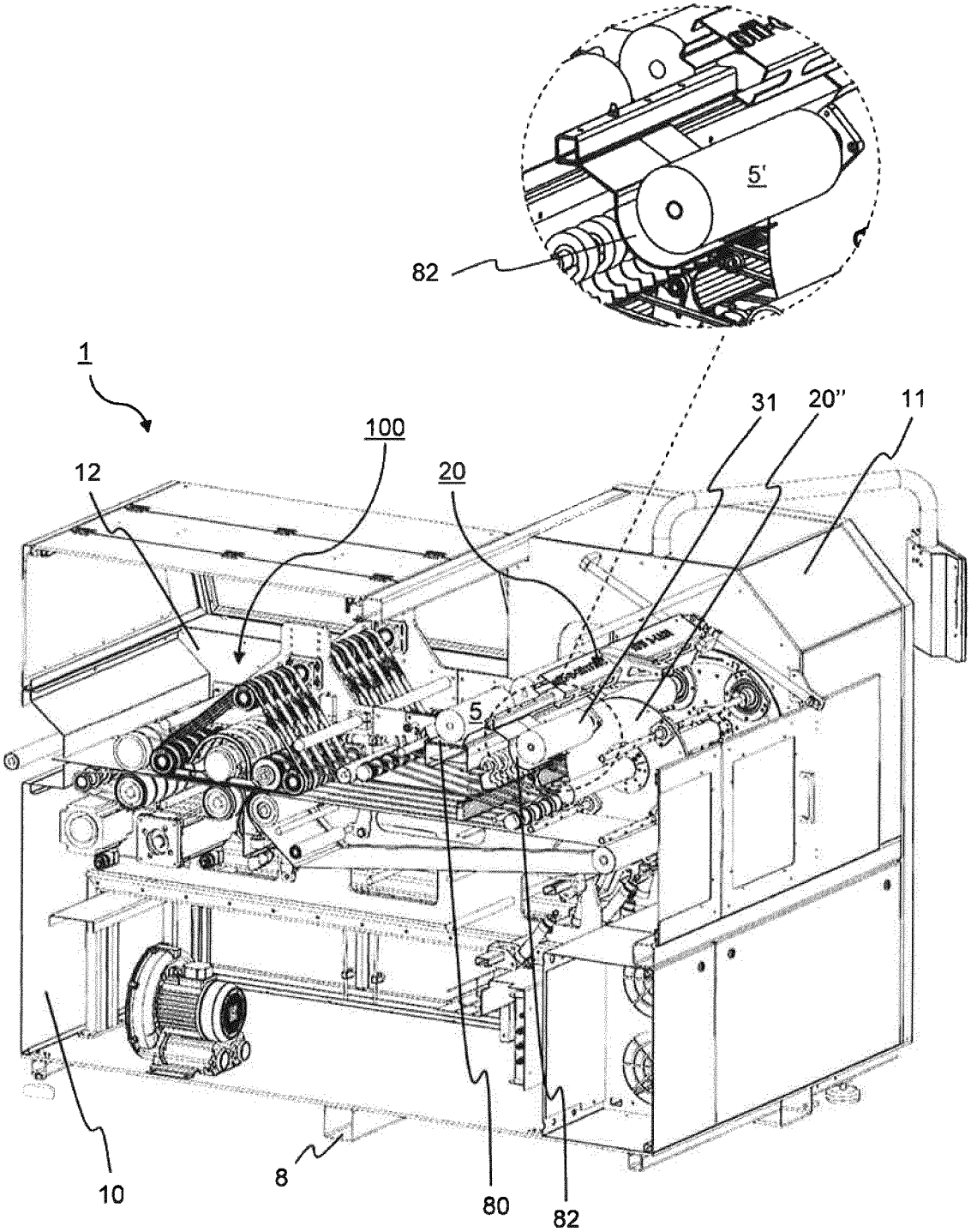
FIG. 1*a* shows a longitudinal perspective and schematic cross-sectional view of a prior art machine 1 as disclosed in WO2016/150946, for processing a flat web (not shown) of a plastic foil being fed into the machine 1 at the part of the machine shown to the left in FIG. 1*a*. The web being processed may by way of example have a width in the order of 10 cm-40 cm, and is preferably based on a primary web of a foil which in a previous step (not shown) has been folded lengthwise, welded cross-wise and provided with cross-wise perforations for easy cross-wise separation of the web into individual short sections. These individual sections may by way of example have an extension along the web in the order of 10 cm-100 cm and may define individual plastic bags. The individualization, or separation, of the sections from each other, may be done by an end-user or by a dedicated separator mechanism part of the machine 1.
Figure 1B:
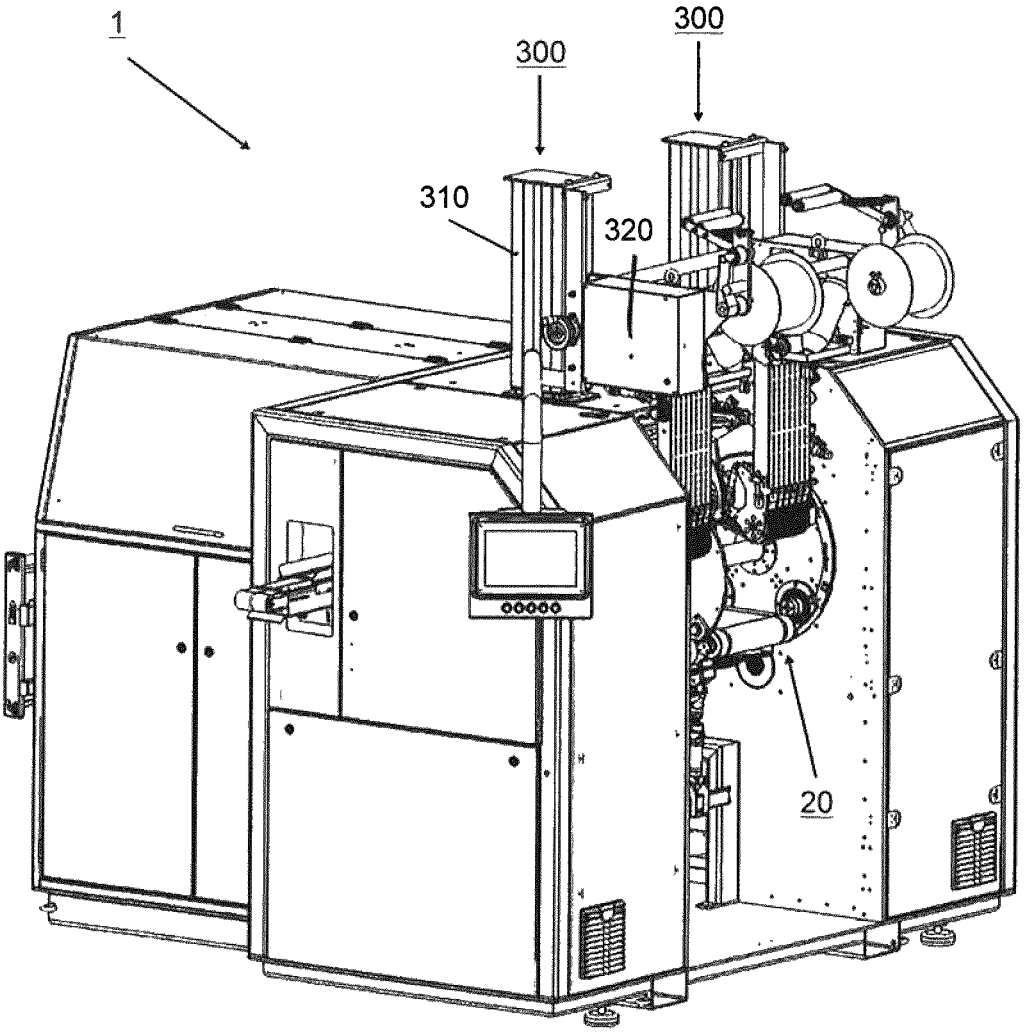

FIG. 1*b* shows the prior art machine 1 of FIG. 1*a*, modified by further including a wrapping device 300 according to the present invention. The purpose of the wrapping device 300 is to apply a wrapping around each of the finished rolls 5, to prevent the finished rolls 5 from unwinding. Normally the wrappings will be in the form of respective elongated bands, often strips of paper serving the function as a label, carrying an adhesive and having a length slightly longer than the circumference of the roll 5 to allow the bands to reach around the roll 5. Such a band having a width normally not exceeding the length of the roll 5 is applied around each roll 5 using the wrapping device 300 of the invention, with the ends of the band overlapping and being glued together, and with the band possibly also adhering to the surface of the roll 5. The wrapping device 300 according to the invention will be discussed later below.

As mentioned, the integral lengths of the web and, where applicable also individualized short sections thereof, are separated from each other using a separator mechanism incorporated in the machine 1. One separator mechanism for performing such a separation is shown by way of example in U.S. Pat. No. 5,588,644; this known machine also performs an interleaving procedure wherein individualized sections separated from each other by the separator mechanism are arranged in a partially overlapping, shingle-like manner, for subsequent rolling-up. The machine part 20, and the wrapping device 300 of the present invention, may find use in connection with a variety of such separator mechanisms.

Integration of the machine part 20 in the machine 1 where the separation of lengths of the web from each other is carried out, preferably with an additional individualization and interleaving of sections of each such length of the web, is preferred as this may lead to significant benefits as regards machine manufacturing costs, easy maintenance and low installation space requirements.

As will be understood from the following the machine part 20 is highly suitable for performing a winding-up procedure for making core-less rolls 5, such as on the basis of interleaved, and optionally statically charged, short sections of a primary web, such as sections defining bags, being presented to the machine part 20 directly from the upstream located separator mechanism which also may perform an interleaving. This separator mechanism is in the drawings referred to by reference numeral 100; FIG. 1*a* shows the separator mechanism 100 acting also to perform an interleaving.

Referring to FIG. 1*a*, the initial processing of the web, including such steps as the separating of the web into sections and interleaving those sections, takes place in the separator mechanism 100 in the left side half of the machine 1 while the machine part 20 for making the rolls 5 is incorporated in the right side half of the machine 1. In this arrangement, the left side half of the machine 1 has the primary web infeed section while the right side half has a section with a conveyor 80 for discharge of completed rolls 5' and located between the separator mechanism 100 and the machine part 20.

The machine 1 of FIGS. 1*a* and 1*b* highly conveniently allows for processing of two parallel streams of a primary web using a separator mechanism 100 acting on both streams; the view of FIG. 1*a* illustrates one half of the machine 1 with most of the elements required for the processing of both of the two parallel primary streams, as well as for winding up of interleaved sections for making rolls 5 from those streams, using the machine part 20. Two subsections 20', 20" of the machine part 20 preferably work in tandem or synchronized.

The machine 1 generally includes a frame 8 and a housing 10 having an end wall 11 delimiting the shown right side half of the machine to the right, as well as two opposite longitudinal sides 12 extending parallel with the aforementioned primary streams, between left and right in FIG. 1*a*. The wrapping device 300 shown in FIG. 1*b* operates as mentioned to provide a wrapping around rolls 5" that have been moved to a dedicated work station before they are discharged, see FIG. 2.

Figure 2:
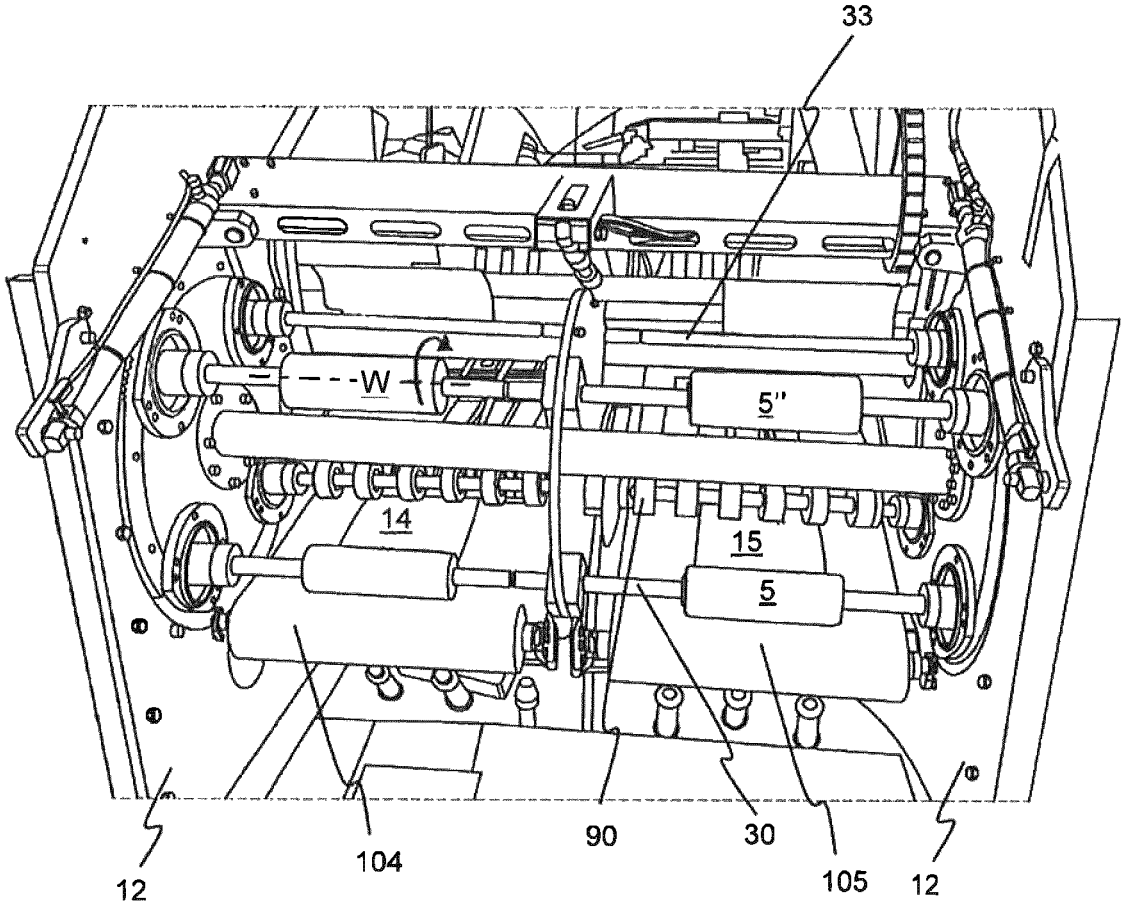

FIG. 2 shows the right side half of the machine 1 as viewed from the outside of the housing 10 to the left in FIG. 1*a*, with the end wall 11 removed. FIG. 2 also shows by numerals 14 and 15 each of the two primary streams after having been processed at the separator mechanism 100, here in the form of interleaved sections of the primary web, being supported by a respective conveyor belt 104, 105. The two parallel conveyor belts 104, 105 extend into the roll-making machine part 20 from the separator mechanism 100, with the downstream end of the conveyor belts 104, 105 being visible in FIG. 2.

As shown in FIG. 2 and in FIGS. 3*a*/3*b* the roll-making machine part 20 of an embodiment of the invention comprises two subsections 20', 20" in extension of each other, preferably working in tandem/being synchronized as explained further below, a central member 25 being arranged between the two subsections 20', 20". The machine part 20 of the shown embodiment generally includes a central axle 22 supported at each end by a respective one of the opposite sides 12 of the housing 10, and driven for rotation by a motor 23. The subsections 20', 20" each have a first spindle support 21', 21", shown here as being a respective disc-shaped element and connected for rotation with the axle 22, whereby stepwise rotation of the axle 22 brings about a corresponding indexing or rotation of the two subsections 20', 20". The central member 25 defines for each subsection 20', 20" a second spindle support 25 which preferably rotates together with the first spindle supports 21', 21". Two individual such second spindle supports 25 arranged back-to-back may also be contemplated.

Figure 3A:
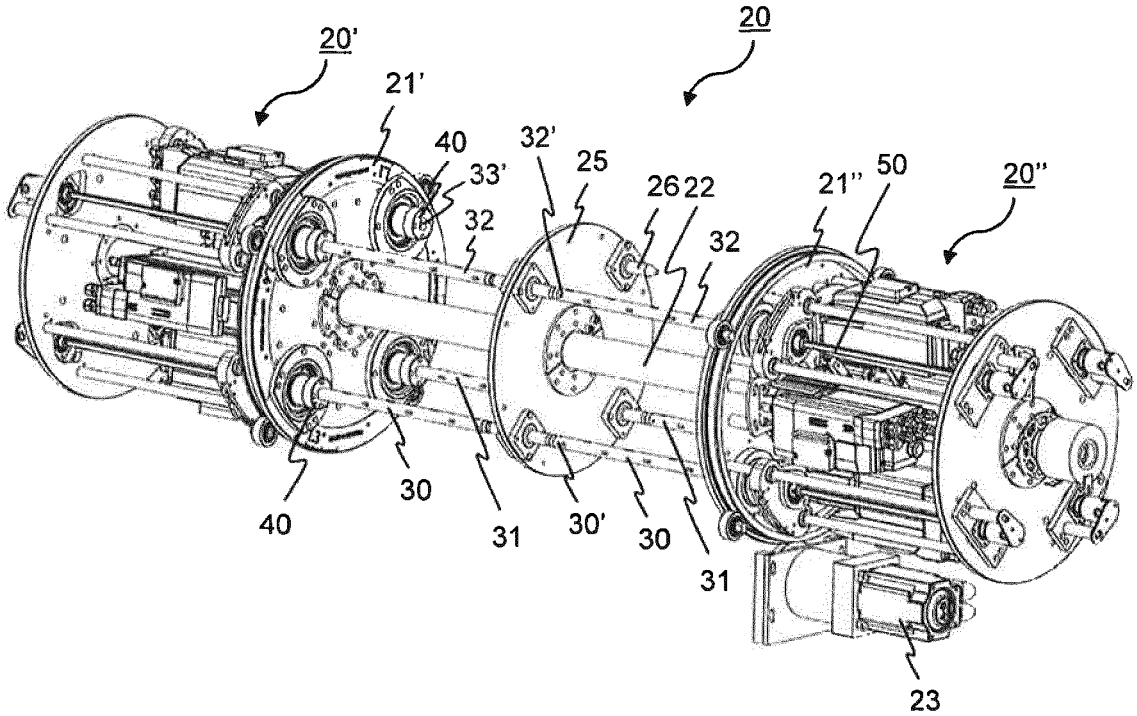
Figure 3B:
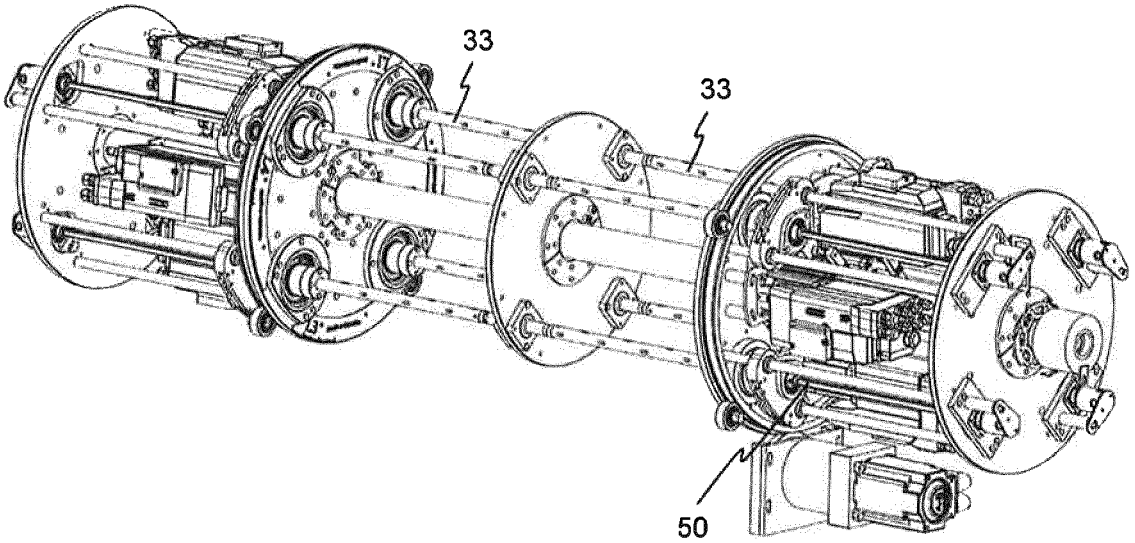

Each subsection 20', 20" includes a number of rotating and retractable elongated spindles carried by the respective first spindle support 21', 21", in the shown embodiment a total of four spindles 30, 31, 32, 33, of which one spindle 33 of each subsection 20', 20" is shown at the instant of being in a fully retracted position in FIG. 3*a* while being visible in the fully extended position thereof in FIG. 3*b*. FIGS. 1*a* and 2 show the spindles 30, 31, 32, 33 all being in the extended configuration shown in FIG. 3*b*. By "retraction" in the present context is meant that a distal end 30', 31', 32', 33' of each spindle 30, 31, 32, 33 becomes located closer to its supporting first spindle support 21', 21", having been moved away from the opposite second spindle support 25. The distal end 33' of retracted spindle 33 is barely visible in FIG. 3*a*. Preferably, but not necessarily, the spindles are cylindrical, with a constant cross-section along a major part of their length onto which the web is rolled, or the spindles 30, 31, 32, 33 can be slightly conical/tapered.

Figure 4:
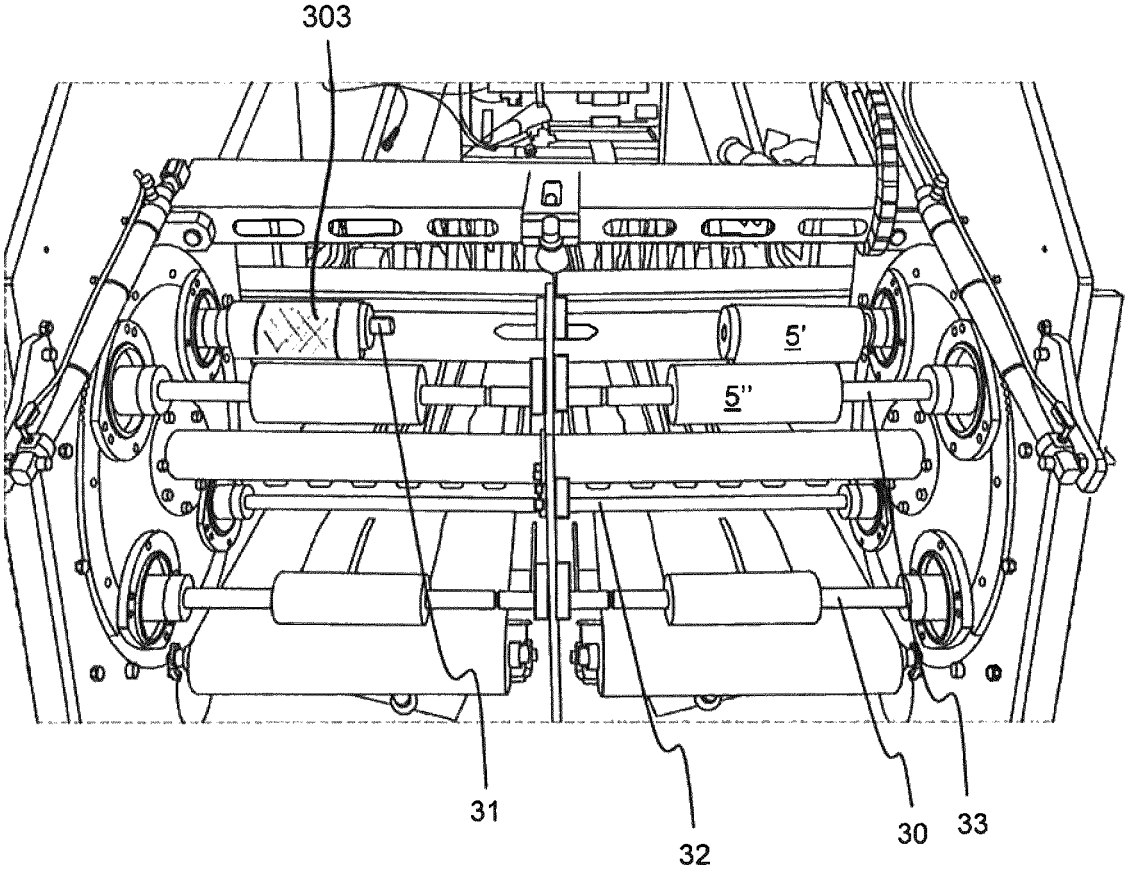

FIG. 4 shows to the right three of the four spindles in the extended position also shown in FIG. 3*a*; a fourth spindle (not visible) with a finished roll 5' carrying a wrapping band (schematically shown on the left side roll in the drawing) is in the process of moving towards the fully retracted position shown in FIG. 3*a* but still supports the roll 5' thereon, see also the enlarged section shown in FIG. 1*a*. In the extended position the distal end 30', 31', 32', 33' of each spindle is received by a bearing 26 mounted to the second spindle support 25 and having a shape complementary to the shape of the distal end, such as the shown tapering complementary to a conical recess formed at the distal end of the spindles. This support at the distal end 30', 31', 32', 33' of the spindles 30, 31, 32, 33 allows for the use of spindles 30, 31, 32, 33 having a relatively small diameter, and is important to prevent or limit sideways deflection of the spindles were they otherwise unsupported at their ends, which deflection in particular may pose problems when winding up on very small diameter spindles is carried out.

As explained, the parallel spindles 30, 31, 32, 33 of each subsection 20', 20" are supported on the one hand by the first spindle support 21, and are normally located at the same distance from the axis around which the spindle supports 20', 20" rotate. The spindles 30, 31, 32, 33 are driven to rotate relative to their first spindle support 21", preferably by being each coupled to a respective servomotor M mounted onto the first spindle support 21" and for individual controlling of the speed of rotation of each spindle 30, 31, 32, 33. The spindles, and their mounting to the spindle support 21, will be discussed in further details later below.

As the subsections 20', 20" are rotated or indexed stepwise so will each spindle 30, 31, 32, 33 consecutively be indexed or aligned stepwise with one lower position at the downstream end of the conveyor belts 104, 105 shown in FIG. 2, and then with another upper position closer to a common, transverse discharge conveyor 80, such as a conveyor belt or conveyor chute, see FIG. 1*a*, via a dedicated work station for wrapping the rolls. Having subsections 20', 20" with more than two spindles 30, 31, 32, 33 each allows for the implementation of such an extra, dedicated work station wherein finished rolls 5", each remaining on a corresponding spindle 30 as shown in FIG. 4, are being provided with a wrapping by the wrapping device 300 shown in FIG. 1*b* and to be discussed later below, such as by being slowly rotated about the spindle axis W in the direction marked by the arrow shown in FIG. 2 by the supporting spindle whilst receiving the aforementioned band/wrapping carrying an adhesive.

As a spindle 32 carrying a finished roll 5" moves to the position shown in FIG. 2 by rotation of the axle 22, another spindle 30, in high speed rotation and being in the process of winding up a roll 5, moves to the position shown in FIG. 2 at the downstream end of the conveyor belts 104, 105, for continued winding-up of that roll 5. As seen in FIG. 4, another spindle 31 is now in position for discharge of a finished roller 5' to the transverse conveyor 80 while yet another spindle 32, ready for use for winding up a new roll, is in a position slightly upstream the feed conveyor 104, 105, slightly above a portion of the web currently being wound up at the downstream end of the conveyor 104, 105 by the spindle 30. At the instant the trailing end of the length of the web material currently being wound up passes below this upstream spindle 32 an actuator located below the conveyor belts 104, 105 acts to raise the conveyor belts 104, 105 locally against this upstream spindle 32, such that the lead end of the subsequent length of the web material is presented to the upstream spindle 32, now at high speed rotation driven by its motor M, for initiating winding up of this subsequent length of the web material, as explained below. It is noted that the conveyor belts 104, 105 are mounted to accommodate for the increasing diameter of the roll 5 being wound up by the spindle 30 in the position shown in FIG. 4, preferably by allowing a vertical movement thereof to and from the downstream spindle 30.

FIG. 2 shows the position of each of the subsections 20', 20" wherein for each subsection winding-up of one roll 5 is in the process of being completed while a finished roll 5' has now been discharged from the machine 1, the spindle 33 nearest the transverse conveyor 30 having been returned to the extended position shown also in FIG. 3*b*.

FIG. 4 on the other hand shows the machine part 20 at a point where to the right a finished roll 5' of wound-up interleaved section of the primary web is being transferred from the spindle 31 to the transverse conveyor belt 80 seen best in FIG. 1, by means of a supporting pivotable tray 82, again seen best in the enlarged view in FIG. 1*a*; alternatively, a gripping device gripping around the roll 5' may be used. A this time, the spindle 31 previously carrying the finished roll 5' has been fully retracted to the position shown in FIG. 3*a*, with an engagement face 40 on the first spindle support 20" pressing against the end of the roll 5' as the spindle 31 is moved to the retracted position. As the spindle is retracted pressurized air exits apertures 60 formed in the spindle 33 to slightly expand the roll 5' from within, thereby ensuring that the roll 5' to a high degree maintains its shape as slides off the spindle 31. The transverse conveyor belt 80 preferably extends between the two opposite sides 12 of the machine 1, to receive rolls 5' transferred from each subsection 20', 20" by a respective pivotable tray 82 or other transfer device; the shown tray 82 has a pivot axle located out of the path of the spindles 30, 31, 32, 33 and allows the finished rolls 5' to fall by gravity onto the conveyor 80 after having turned to an upright position from the supporting horizontal position shown in FIG. 1*a*. In this way, finished rolls 5' may be discharged from the machine 1 at only one side 12 thereof, by the conveyor 80.

Figure 5A:
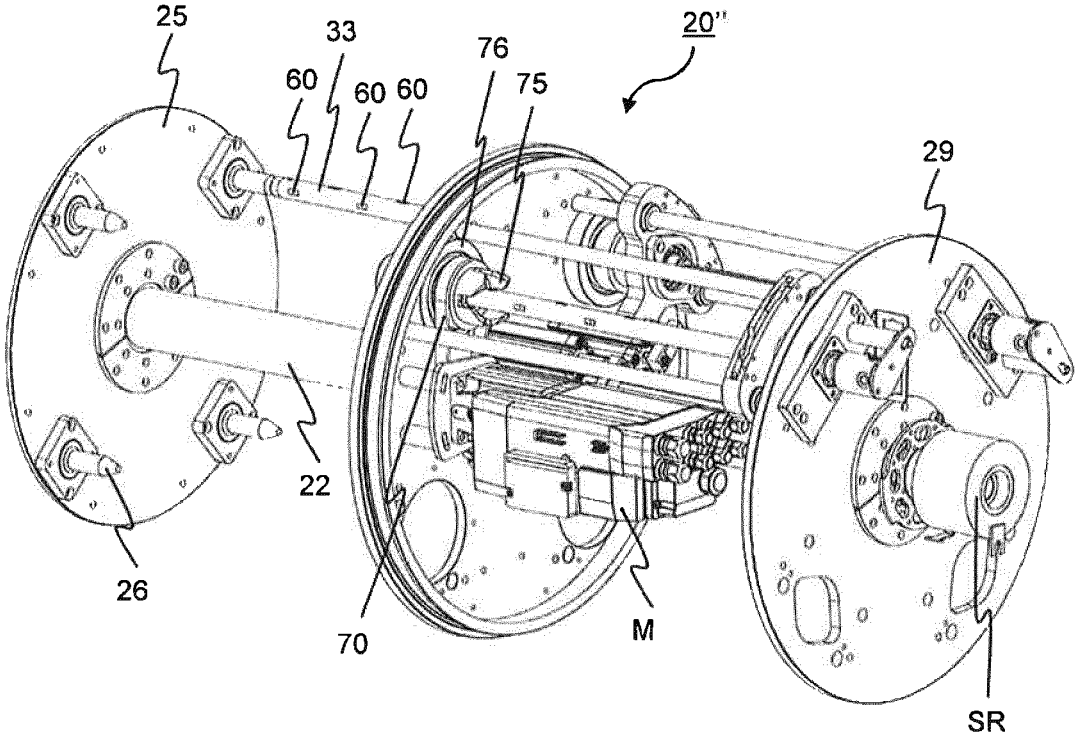
Figure 5B:
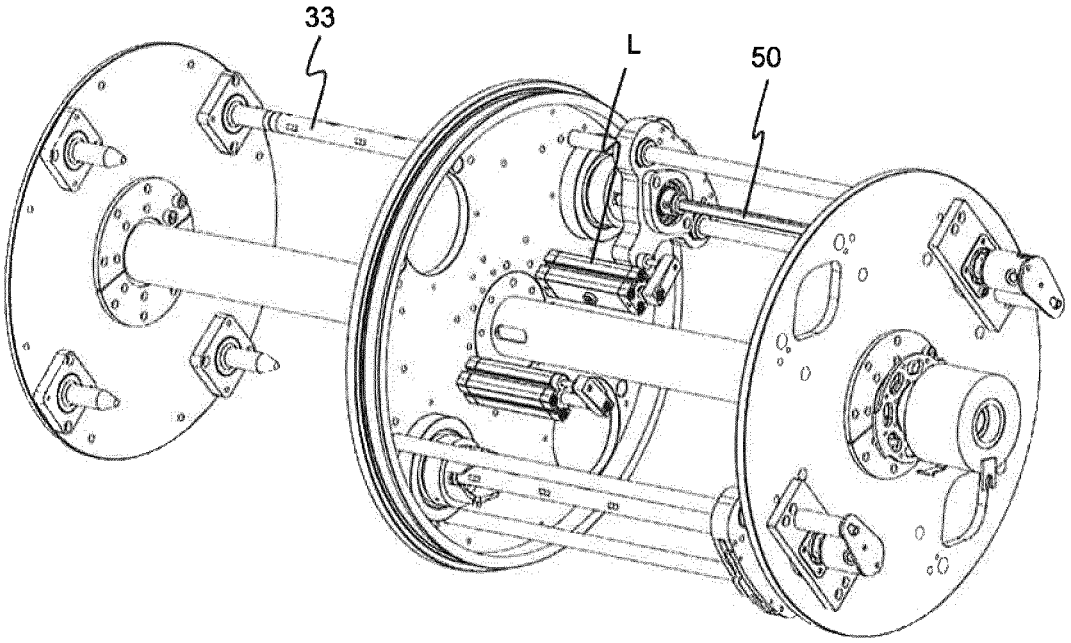
Figure 6A:
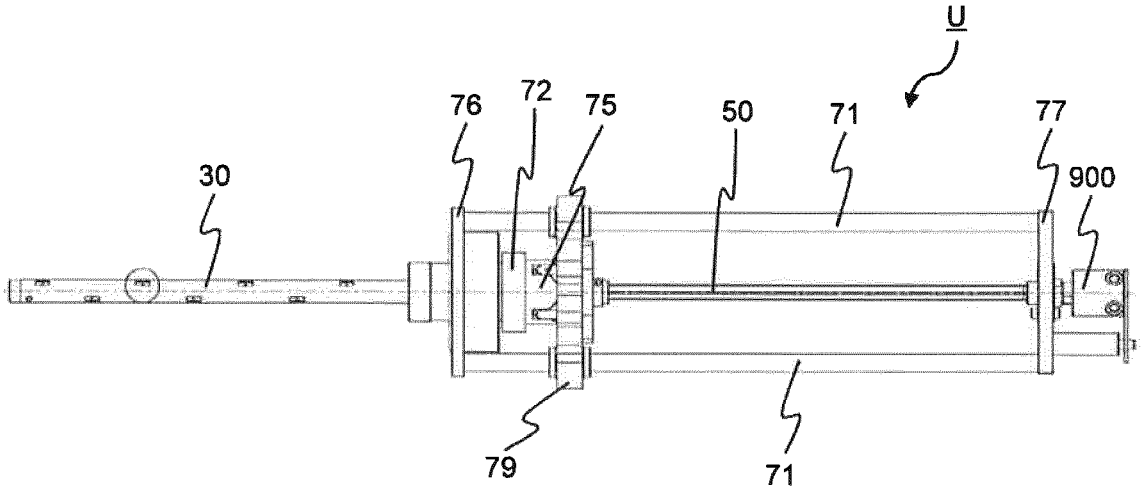
Figure 6B:
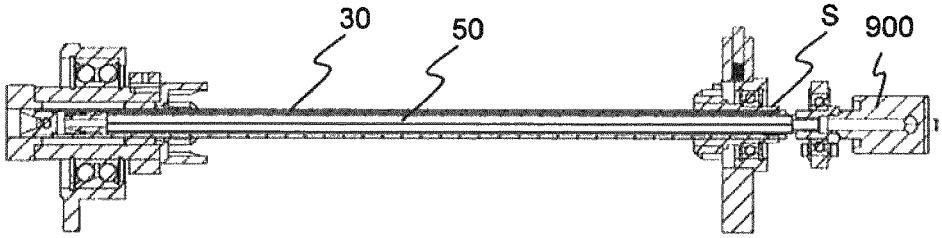

For simplicity, one subsection 20" of the two subsections will now be described in further details with reference to FIGS. 5*a* and 5*b*; yet further details with respect to the spindles are shown in FIGS. 6*a* and 6*b*; it should be understood that the same details are found in the other subsection 20'.

Turning to FIG. 5*a*, for simplicity two of the spindles shown by numerals 30 and 31 in FIG. 3*a*, as well as driving elements for the retraction of those spindles, have been removed. In FIG. 5*b* all but one spindle 33 have been removed.

The preferred embodiment utilizes spindles 30, 31, 32, 33 that are each along the length thereof provided with an array of the aforementioned apertures 60 connected to an interior passage through which a vacuum can be drawn and/or through which the aforementioned pressurized air may flow to exit the apertures 60. Before starting to wind up a coreless roll 5 thereon, an empty spindle such as spindle 32 shown in FIG. 4 will be indexed to a position above the stream of web in the process of being wound up downstream at spindle 30 located adjacent the downstream end of the feed conveyor 104, 105. Timed to coincide with the spindle 30 having almost finished roll 5, i.e. corresponding to the instant shown in FIGS. 2 and 4, brushes 90 are pivoted downwardly generally next to spindle 32. When the free, leading edge of the length of the web material to be rolled up on the spindle 32 approaches the spindle 32 forwarded by conveyor 104, 105 vacuum is applied through the apertures 60 in the rotating spindle 32; together with the rotating brushes 90 this will cause the aforementioned leading edge to wrap around the spindle 32 while the trailing edge of the roll 5 on spindle 30 is wound up on the spindle 30, as will be described in details with reference to FIGS. 8*a* and 8*b*.

Figure 8A:
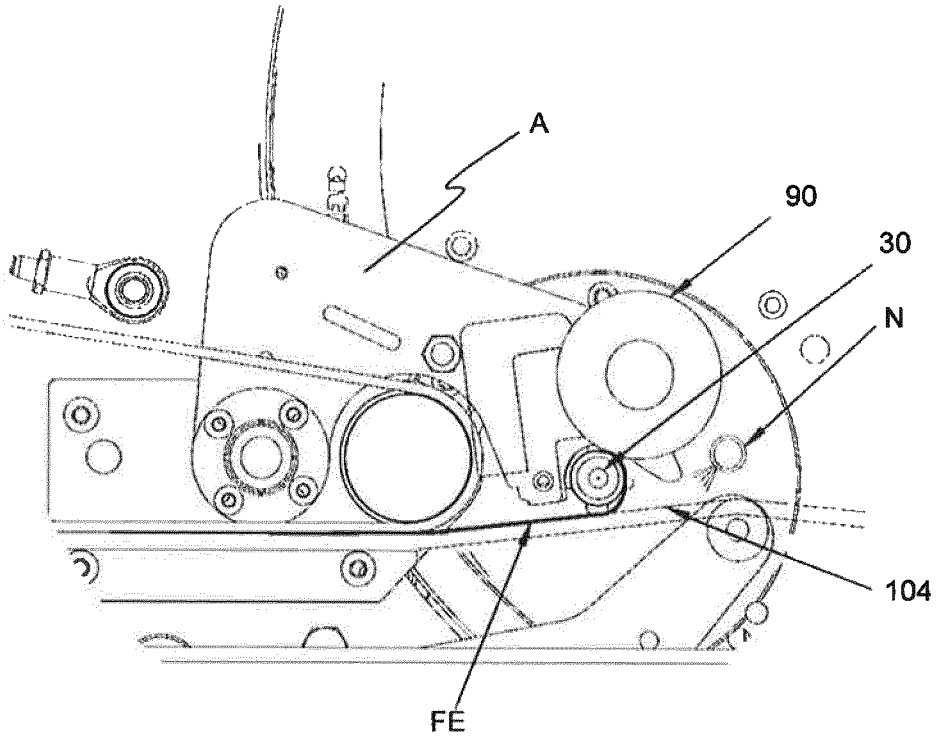
Figure 8B:
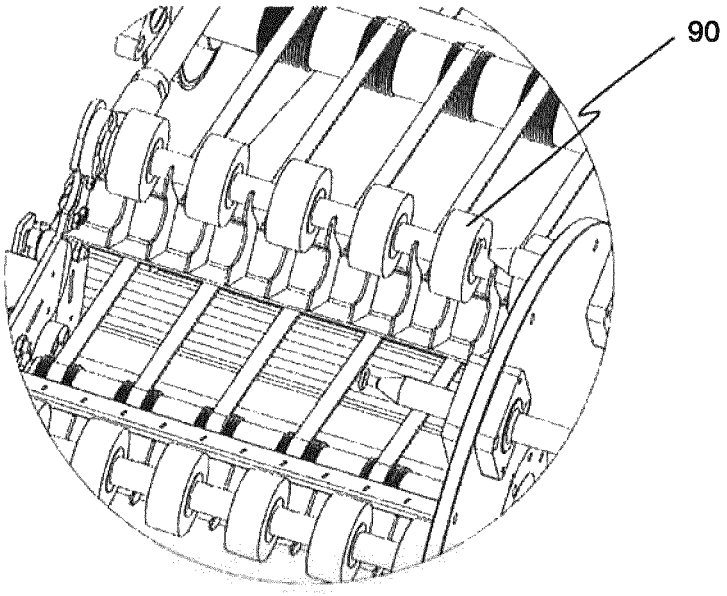

FIGS. 8*a* and 8*b* are views showing an arrangement of the aforementioned brushes 90 acting to initiate the winding-up, together with a set of nozzles N applying a jet of air against the leading free edge FE of the web having been folded around the spindle 30, while vacuum is also being applied through apertures 60 in the spindle 30. The nozzles N and brushes 90 are carried by a pneumatically driven or motor driven arm A allowing for the downward pivotal movement thereof into correct position of the brushes 90 next to the spindle 30. FIG. 8*b* is a perspective schematic view with some elements removed and showing the arm A in a raised position with a row of brushes 90.

As will be understood the brushes 90 act to help this first web section get started on the rotating spindle 30. The supporting conveyor 105 may also preferably be raised slightly to serve the new bag to the spindle 32. Once the first bag/section (and possibly more than one bag) is secure on the spindle 32 the subsection 20" will index or rotate to the position shown in FIG. 4 and the roll 5" will then finish winding on the spindle now located at the downstream end of the conveyor 104, 105.

As seen in FIG. 5*b* the first spindle support 20" carries a plurality of individual air flow conduits 50, each being telescopically receivable by a respective spindle 30, 31, 32, 33 when the latter moves to the retracted position. The air flow conduits 50 are each being connected to a source of pressurized air and optionally and selectively also to vacuum.

When in the extended position each spindle 30, 31, 32, 33 is driven to rotation by its corresponding motor M supported by the rotating first spindle support 20", through a drive 70. This drive 70 may simply, as shown in FIG. 5*a*, be a toothed belt acting on a corresponding surface 72 of a rotating structure supported by the first spindle support 21" via bearings by a mount 76, see FIG. 6*a*.

FIG. 5*a* shows one spindle/air flow conduit unit U as shown in more details in FIG. 6*a* mounted i) onto the first spindle support 20" via the aforementioned mount 76, and ii) onto another, opposite supporting structure 29 of the subsection 20" via a further mount 77. A sled 79 is coupled to the proximal end of the rotating spindle 30 via bearings and runs on opposed guiding bars 71; the sled 79 is driven for controlled movement along the length of the guiding bars 71 by a sled drive D (seen in FIG. 5*c*) fixed to the housing 10 of the machine 1 next to the roll-discharge position of the spindles, i.e. at the position P shown in FIG. 5*c*, to which position the spindles are brought by the rotating first spindle support 21". More specifically, on activation of the sled drive D by a controller, as will be the case when a finished roll 5 is to be released from a spindle, the sled drive D engages the sled 79 to move the spindle 30 to the retracted position, i.e. to the right in FIG. 6*a*, with the spindle 30 at the same time telescopically receiving the air flow conduit 50. This movement/retraction of the spindle 30 and the sled 79 by the sled drive D disengages the sled 79 from a clutch part 75 on the part having the surface 72, whereby the spindle 30 is no longer driven to rotation by the motor M. When the sled drive D is activated to reverse the aforementioned movement a lock L engages the sled 79 and clutch part 75 is reengaged as the spindle 30 reaches its fully advanced position, in order to maintain by the lock L this advanced position when the first spindle support 21" is then rotated by axle 22 and the spindles rotated by their motors M.

The air flow conduit 50 is preferably formed as a straight tube supported by the further mount 77 at one end and within the spindle 30 at its other end; preferably, the air flow conduits 50 have a non-circular, such as square, outer contour received by a correspondingly shaped structure S inside the proximal end of the cylindrical spindles 30, so that there is no relative rotational movement between the spindles and their corresponding air flow conduits.

The described structure allows for the use of a highly simple sliding air seal between the spindle 30 and the corresponding air flow conduit 50 since there is no relative rotational movement; the air seal prevents pressure loss through apertures 60 in the spindle 30 located near the proximal end of the spindle 30. Such a loss would be undesirable since a high air pressure must still be maintained in the distal portion of the spindles on which the finished roll still remains until the spindle 30 is fully retracted; absent such a high pressure the roll cannot be discharged without destroying its cylindrical form.

A connection 900 at the end of the air flow conduit closest to the further mount 77 connect the inside of the air flow conduit 50 and, hence, the spindle 30 with a source of pressurized air/vacuum.

Figure 7:
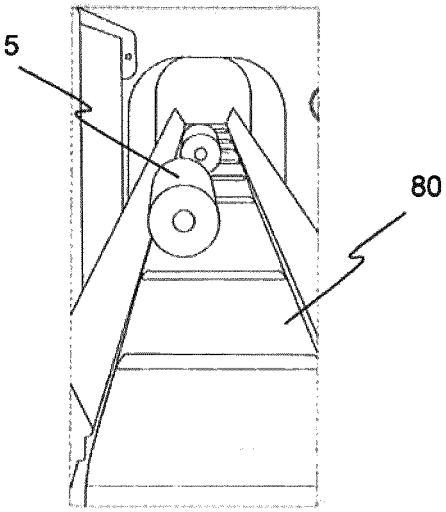

FIG. 7 is a view showing a portion of the machine 1 as viewed towards side 12 and showing a side opening for discharging finished rolls 5 advanced by the conveyor 80.

While rotation of the second spindle support 25 together with the first spindle support 21" is preferred, a circular track providing locally the aforementioned bearings 26 may be provided in a stationary second spindle support 25, for supporting the distal ends of the spindles 30, 31, 32, 33 and allowing the spindles to change position as the first spindle support 21', 21" is rotated. Such a circular track may have local bearing 26, such as in the form of notches or recesses complementary with the distal end of the spindles, and into which notches the distal ends enter on being rotated by the first spindle support 21' to eg. the winding positions shown in FIG. 4.

It is noted that the present invention also relates to a method of operating the disclosed machine part 20, wherein discharge of the finished rolls take place by sliding the rolls off the spindles through the step of retracting the spindles while at the same time withholding the rolls by providing an engagement surface acting against the end face of the rolls.

Conveniently, the aforementioned apertures 60 have a transverse dimension increasing towards the outer surface of the spindles 30, 31, 32, 33, for providing an increased contact area with the web/core on the spindles.

While not shown herein, the invention is also suitable for making rolls with a separate core applied to a spindle 33 in, by way of example, the position shown in FIG. 2 after removal after a finished roll. The core is preferably held in position on the spindle 30 against relative rotation by a vacuum applied through the apertures 60, and winding up then is assisted by the aforementioned brushes 90 and nozzles N.

Figure 5C:
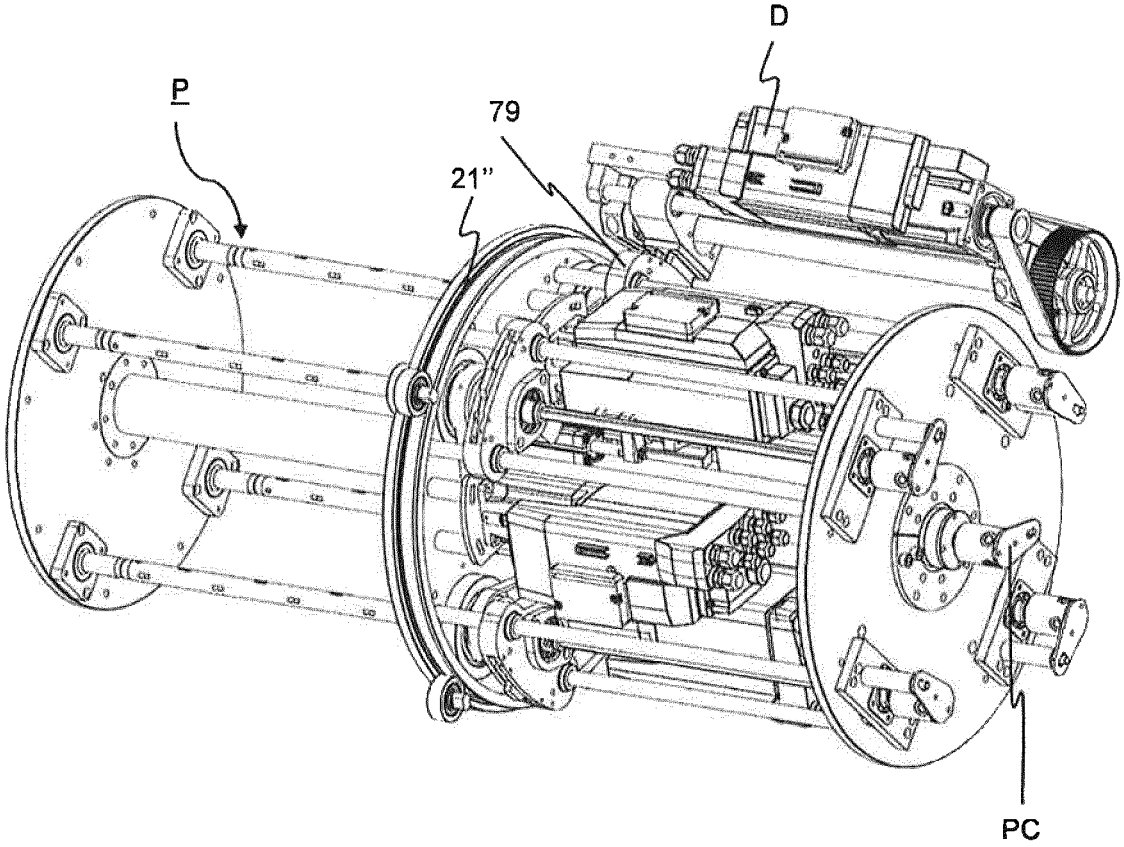

It is noted that controlling of the motors M with build-in servo controller may be by bus signals with digitally coded signals which, together with the driving power, may be transferred from stationary parts of the machine part to the rotating subsections 20', 20" through a slip ring SR/rotating electrical connectors, part of which is seen mounted to the right in FIG. 5*a*, on the supporting structure 29 of the subsection 20". A rotating pneumatic coupling PC supplying pressurized air/vacuum to the individual connections 900 (see FIG. 6*b*) is shown in FIG. 5*c*, prior to mounting of the slip ring SR. Using motors M with build-in servo controllers allows for a reduction in the number of electrical connections required for the slip ring. Vacuum may alternatively or additionally be generated by means of an ejector setting-up the required vacuum through supply of pressurized air.

Reference will now be made to FIGS. 1*b* and 9-12 for a detailed description of the wrapping device of the present invention. While the wrapping device is shown in FIG. 1*b* as comprising two essentially identical units in the following only one such unit will be discussed and referenced to as wrapping device 300. In this context it is emphasized that while a dual unit wrapping device 300 may be highly suitable for a roll-making machine as shown in FIG. 1*a* adapted for the processing of two parallel streams of a primary web this is only one possible use. In particular, the wrapping device 300 discussed in the following is generally but not exclusively useful for implementation with a roll making apparatus 1 comprising a frame 8 with a feed conveyor 105 for advancing a length of a web, or inter-leaved sections of a length of a web, to be wound up as a roll 5, a subsection 20" with a first spindle support 21" being mounted to rotate and carrying a plurality of parallel elongated spindles 30, 31, 32, 33, each spindle 30, 31, 32, 33 mounted to rotate about a respective axis W relative to the first spindle support 21", for winding up thereon said length of a web, or inter-leaved sections of a length of a web, the rotation of the first spindle support 21" and of the spindles 30, 31, 32, 33 being about a respective axis perpendicular to, or essentially perpendicular to, the advancing, wherein the spindles 30, 31, 32, 33 are movable between a retracted position, with a respective distal end 30', 31', 32', 33' thereof closer to the first spindle support 21", and an extended position.

The wrapping device 300 shown in FIG. 1*b* comprises a vertical column 310 carrying a main body or frame 320 which may be moved down the column 310, into an active position as shown in FIG. 1*b*. Moving the main body 320 up along the column 310 to an inactive, raised position allows for easy access to and maintenance of the machine part 20.

In the active position the main body 320 has a first conveyor to be discussed below located adjacent a spindle 33 that carries a wound up roll 5" and that has been moved by rotation of the spindle support 21" into a dedicated position, as shown in FIGS. 2 and 4. The wound-up roll onto which a band-like wrapping is to be applied is identified by numeral 5" in the drawings. A finished roll carrying the band-like circumferential wrapping, identified by numeral 303, is shown in FIG. 4.

Figure 9:
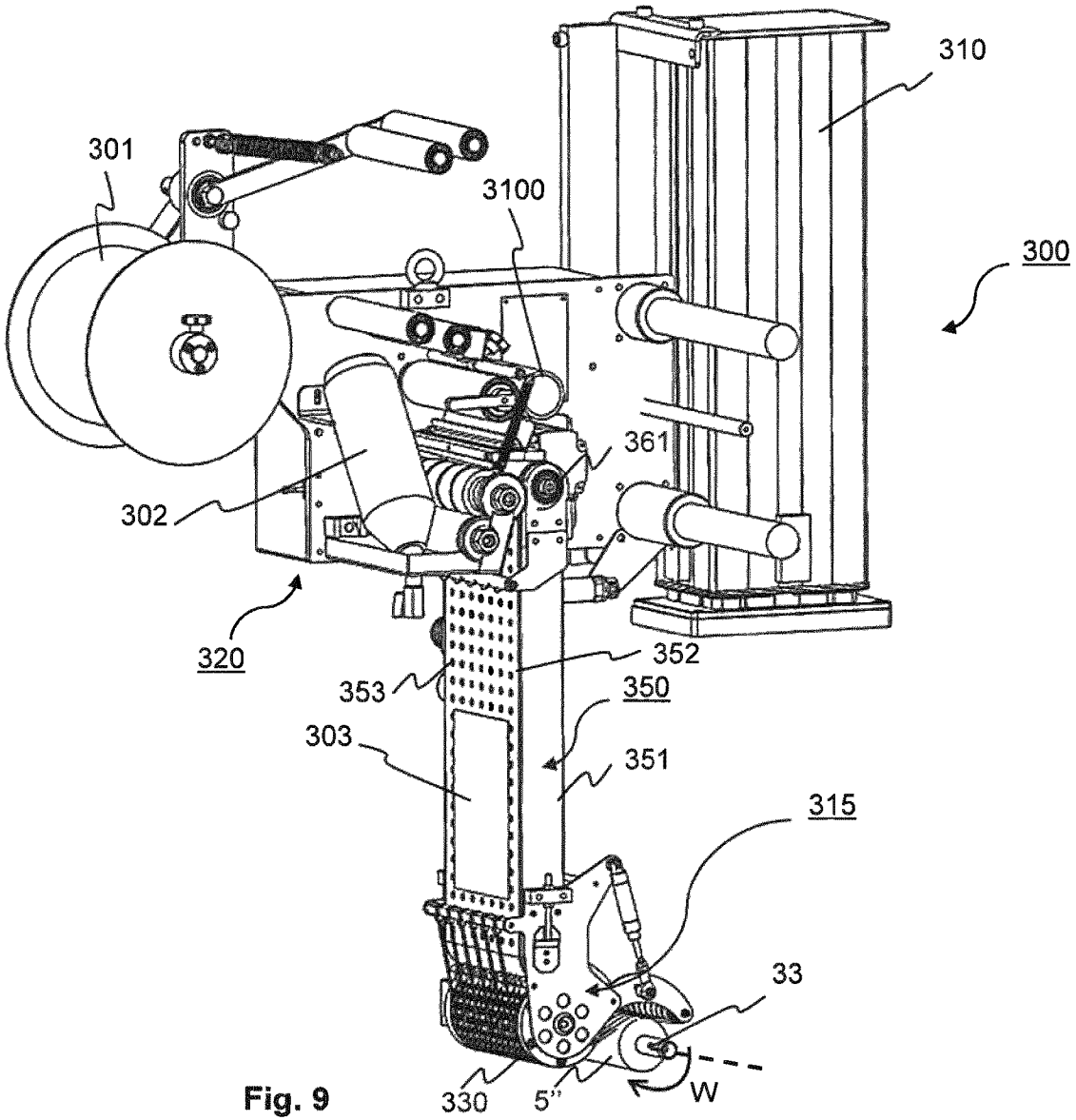

Generally, as shown in FIG. 9, the wrapping device 300 comprises a storage 301 with a rolled-up web defining a succession of bands, each to be wrapped around a respective roll 5" tightly wound up on a spindle 33 and moved into position adjacent the wrapping device 300. A cutter (not shown) may be provided for separating the web into individual bands, of which one band is identified in the drawings by reference numeral 303. The bands 303 may carry text to identify the roll 5" and, hence, serve the function of a label while at the same time securing the roll 5" against unwinding until the roll 5" is to be used. The bands 303 may be self-adhesive with a removable release paper, or an adhesive carried on one side/face of the band 303 may be configured for being activated upon application of a liquid activator, such as water, dispensed from a container 302, or an adhesive may be supplied to the band 303, such as by spraying using nozzles, from the container 302. The web of bands 303 is preferably unwound from the storage 301 by suitable rollers 3100 activated to stop and start synchronized with the positioning of spindles 30 carrying a roll 5" adjacent the main body 320 of the wrapping device 300. With the wrapping device 300 discussed below it may conveniently be avoided that that any major surfaces of the device 300, including in particular the conveyors for advancing the bands 303 to the rolls 5", will contact the adhesive.

The wrapping device 300 moreover comprises a first conveyor 330 and a second conveyor 350, the first conveyor 330 being located immediately adjacent the roll 5" carried by spindle 33, as shown in FIG. 9 where no other structure of the machine part 20 than the spindle 33 carrying the roll 5" is shown. The first conveyor 330 is for conveying the band 303 to the roll 5" from the wrapping device 300 while the second conveyor 350 is for conveying the band 303 from storage 301 to the first conveyor 330. In any case the band 303 may be conveyed to the roll 5" in a position wherein the adhesive carried on the surface of the band 303 faces away from the supporting surface of the first and second conveyors, 330, 350.

In the shown embodiment the second conveyor 350 includes an elongated box-like hollow conduit 351 connected at one end to a source of vacuum (not shown). A looped moving belt 352 driven by servo motor 361 extends along the conduit 351 and has a plurality of apertures 353 communicating with the inside of the conduit 351 and, hence, the source of vacuum. Individual bands 303 are transferred to the looped belt 352 from the rollers 3100 and held to the looped belt 352 against gravity by the applied vacuum.

The first conveyor 330 is a part of a wrapping unit 315 secured to an end of the hollow conduit 351. This unit 315 shown in greater details in FIG. 10 comprises a unit frame 316 in which is rotatably journaled the aforementioned first conveyor 330. More specifically, the first conveyor 330 is a cylindrical drum configured for rotation about an axis that is parallel with the axis W about which rotates the spindle 30 carrying the roll 5" to be wrapped, cf. FIG. 9.

Figure 10:
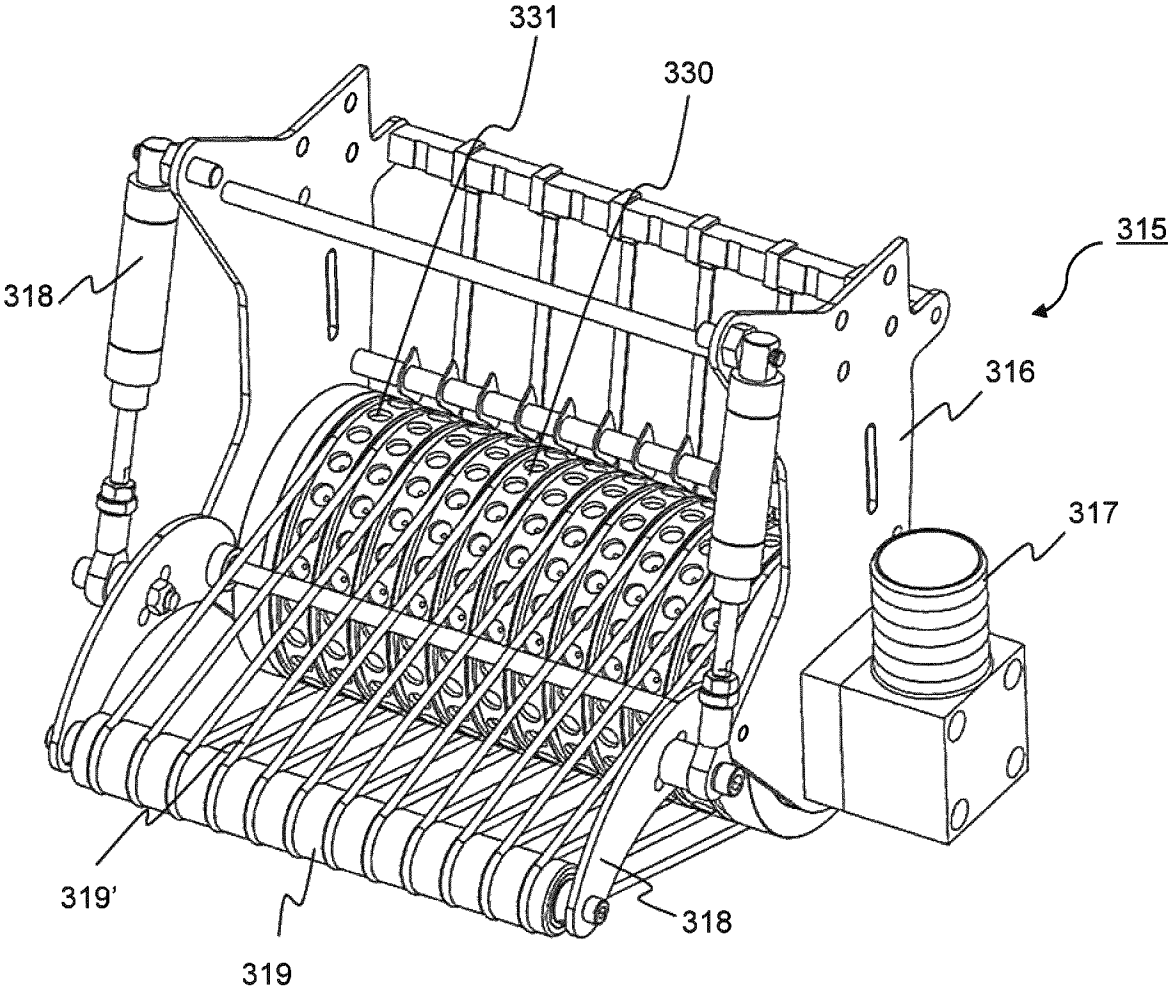

The drum 330 has a surface configured for receiving and transferring the band 303 to the wound up roll 5" by a vacuum applied to the band 303 via apertures 331 formed in the surface of the drum 330. FIG. 10 does not show details relating to the drive for rotating the drum 330. FIG. 10 shows a coupling 317 for attaching a hose leading to a source of vacuum communicating via the hose with the inside of the drum 330. Also shown in FIG. 10 is a pivot frame 318 pivotally connected to the unit frame 316 by actuators 318'. The pivot frame 318 has a roller 319 and elastic belts 319' acting to guide a band 303 being transferred to the roll 5" when the pivot frame 318 is in the active position shown in FIG. 9. In this active position is the roller 319 located on a side of the roll 5" opposite the drum 330.

Figure 11:
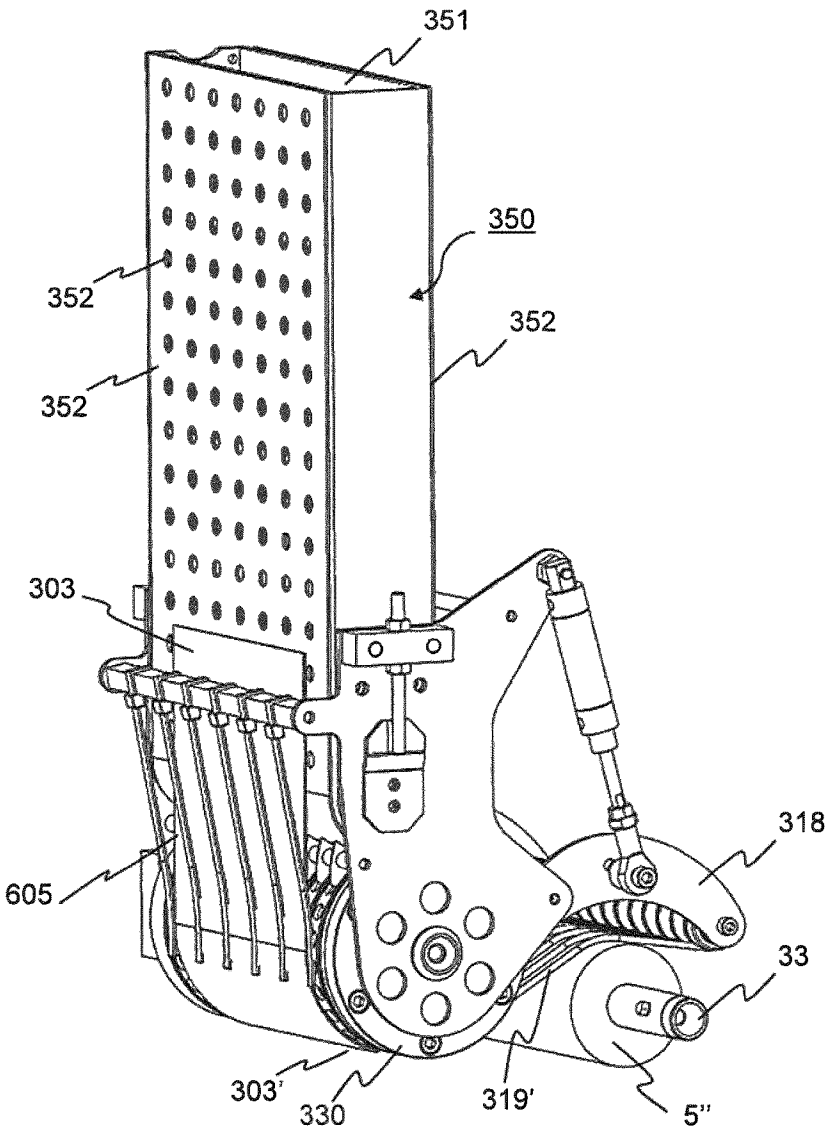

A band 303 in the process of being transferred to the first conveyor 330 from the looped moving belt 352 is shown in FIG. 11 which shows the band 303 held at this instant by the vacuum in conduit 351 via the apertures 351 in the moving belt 352 as well as by the vacuum in the inside of the drum 330 via the apertures 351 formed in the surface thereof. Flexible guiding pin 605 may be provided for directing the leading edge portion 303' of the band 303 towards the drum 330.

From the drum 330 the band 303 is transferred to the roll 5" through the rotation of the drum 330 and in such a manner that the adhesive carried on the face of the band 303 is brought into contact with the surface of the roll 5".

Figure 12:
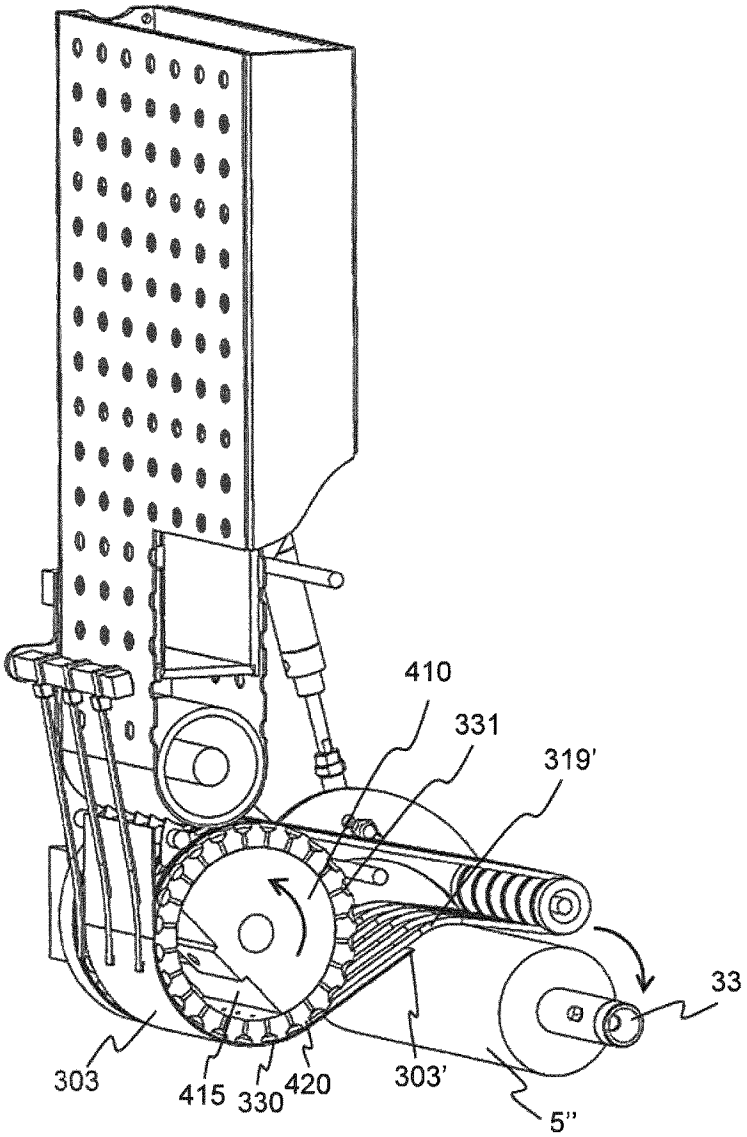

The sectional view of FIG. 12 shows the band 303 having left the looped belt 352 and having the leading end portion 303' contacting the roll 5" while being guided around the top thereof by the elastic belts 319' of the pivot frame 318. The curved form of the band 303 imparted by the drum 330 and the overall speed of operation ensures that this leading end portion 303' reaches the roll 5" surface at the upper portion of the roll 5", ready to by guided around and along the contour of the roll 5" by the belts 319' held against the roll 5" by the actuators 318' maintaining the pivot frame 318 in the shown position. It will be understood that the drum 330 and the spindle 33 carrying the roll 5" are counter-rotating; the directions of rotation of the drum 330 and of the roll 5" on the spindle 33 are shown by arrows in FIG. 12; the respective speeds of rotation are synchronized, the roll 5" rotating together with the spindle 33.

Preferably, the drum 330 is configured for progressively releasing the vacuum applied to the band 303 as the band 303 is transferred to the roll 5" on rotating the drum 330. For this the first conveyor 330 includes, as shown in FIG. 12, a fixed core 410 surrounded by a tubular casing 410 defining the drum 330, and the unit 315 includes a drive (not shown) for rotating the tubular casing 410 relative to the core 410. As seen the core 410 is configured as a structure surrounded by the casing 410 and defining an elongated passage 415 communicating with those apertures 331 of the drum 330 covering at a given time the passage 415. The passage 415 communicates with the source of vacuum via the hose and coupling 317; hence, only some of the apertures 331 will apply vacuum at a given time, and this only against a portion of the band 303 covering those apertures 331 passing over the passage 415. As may be understood the application of vacuum is thereby controlled by the rotation of the tubular casing 330 relative to the core 410.

After completion of the wrapping is the pivot frame 318 moved into a position away from the spindle 33, by activating the actuator 318', whereby the spindle 33 may be moved by rotation of the spindle support 21" towards the position wherein the wrapped roll 5' is discharged from the wind up machine 1.

Where the wind up apparatus comprises a single rotatable spindle, without a rotatable turret, the wrapping device 300 may be configured to be movable as such into a position next to the spindle carrying the roll, for wrapping the band around the roll, with or without the frame 318 being pivotable and preferably including the elastic belts 319' acting to press the band 303 against the roll 5" during the rotation to ensure proper adhesion between the roll 5" and the band 303.

The invention claimed is:

1. A wrapping device for wrapping a band around a roll formed by winding up a length of a web, or interleaved sections of a length of a web, said wrapping device comprising:

a storage for a band to be wrapped around a formed roll;

a conveyor positionable adjacent said formed roll, for conveying said band to said formed roll, said conveyor comprising:

a cylindrical drum configured for rotation about an axis (W), said cylindrical drum comprising a surface configured for receiving and transferring said band to said formed roll by a vacuum applied to said band via apertures formed in said surface;

a pivot frame pivotally connected to a conveyor frame comprising said cylindrical drum;

an actuator configured for turning said pivot frame between an active and an inactive position relative to said conveyor frame, said pivot frame comprising a roller and elastic belts acting to guide said band being transferred to said formed roll when said pivot frame is in said active position;

a core surrounded by a tubular casing defining said cylindrical drum; and a drive for rotating said tubular casing relative to said core, only some of said apertures applying said vacuum at a given time, wherein application of said vacuum being controlled by rotation of said tubular casing relative to said core.

2. The device according to claim 1, said cylindrical drum being configured for progressively releasing said vacuum applied to said band as said band is transferred to said formed roll on rotating said cylindrical drum.

3. The device according to claim 1, comprising a second conveyor for conveying said band from said storage to said conveyor.

4. The device according to claim 3, said second conveyor comprising:

a conduit connected to a source of vacuum; and a looped moving belt extending along said conduit having apertures communicating with said conduit.

5. The device according to claim 1, said roller being located on a side of said formed roll opposite said cylindrical drum in said active position.

6. A roll making apparatus including a roll wrapping device, said roll making apparatus comprising:

a frame comprising a first conveyor for advancing a length of a web, or interleaved sections of a length of a web, along a direction to be wound-up as a roll;

a subsection comprising:

a spindle support mounted to rotate and carrying a plurality of parallel elongated spindles, each of said plurality of parallel elongated spindles mounted for rotation about a respective axis relative to said first spindle support, for winding up thereon said length of said web, or interleaved sections of said length of said web, to form said roll said rotation of said spindle support and of each of said plurality of parallel elongated spindles being about a respective first axis (W) perpendicular to, or essentially perpendicular to, said direction of said advancing;

said plurality of parallel elongated spindles being movable between a retracted position, with a respective distal end thereof closer to said spindle support, and an extended position, each of said plurality of parallel elongated spindles carrying said roll being positionable by rotation of said spindle support in a wrapping position located next to said wrapping device;

wherein said roll wrapping device comprises:

a storage for a band to be wrapped around said roll;

a second conveyor positioned adjacent said roll, for conveying said band to said roll, said second conveyor comprising a cylindrical drum configured for rotation about a second that is parallel with said first axis (W) of rotation of said spindle carrying said roll, said cylindrical drum comprising a surface configured for receiving and transferring said band to said roll by a vacuum applied to said band via apertures formed in said surface.

7. The apparatus of claim 6, said cylindrical drum and said spindle carrying said roll being configured for rotation in opposite directions, for said transferring of said band.

8. The apparatus of claim 6, said cylindrical drum being configured for progressively releasing said vacuum applied to said band as said band is transferred to said roll on said rotating of said cylindrical drum.

9. The apparatus according to claim 6, said first second conveyor comprising a core surrounded by a tubular casing defining said cylindrical drum, a drive for rotating said tubular casing relative to said core, only some of said apertures applying said vacuum at a given time, said application of said vacuum being controlled by said rotation of said tubular casing relative to said core.

10. The apparatus according to claim 6, comprising a third conveyor for conveying said band from said storage to said second conveyor.

11. The apparatus according to claim 10, said third conveyor comprising:

a conduits connected to a source of vacuum; and a looped moving belt extending along said conduit having apertures communicating with said conduit.

12. The apparatus according to claim 6, said wrapping device comprising:

a column; and a wrapping device frame supporting at least said second conveyor, wherein said wrapping device frame being displaceable supported by said column so as to be vertically movable relative to said spindle support.

13. The apparatus according to claim 6, said band carrying an adhesive on one side, said storage configured for delivering said band to said cylindrical drum with said adhesive facing away from said surface of said cylindrical drum.

14. The apparatus according to claim 6, said wrapping device comprising a pivot frame pivotally connected to a first conveyor frame comprising an actuator configured for turning said pivot frame between an active and an inactive position relative to said conveyor frame, said pivot frame comprising a roller and elastic belts acting to guide said band being transferred to said formed roll when said pivot frame is in said active position, said roller preferably located on a side of said roll opposite said cylindrical drum in said active position.

15. A roll making apparatus including a roll wrapping device, said apparatus comprising;

a frame comprising:

a feed conveyor for advancing a length of a web, or interleaved sections of a length of a web, along a direction to be wound-up as a roll;

a spindle support carrying an elongated spindle mounted for rotation about an axis (W) perpendicular to, or essentially perpendicular to, said direction of advancing, for winding up thereon said length of said web, or interleaved sections of said length of said web, to form said roll;

a wrapping device comprising:

a storage for a band to be wrapped around said roll;

a conveyor positioned adjacent said roll, for conveying said band to said roll, said conveyor comprising a cylindrical drum configured for rotation about an axis parallel with said axis (W) of rotation of said spindle support carrying said roll, said cylindrical drum comprising a surface configured for receiving and transferring said band to said roll by a vacuum applied to said band via apertures formed in said surface, said cylindrical drum configured to be movable into a position next to said spindle support carrying said roll, for wrapping said band around said roll, said cylindrical drum and said spindle support configured for rotating in opposite directions.

16. The device according to claim 2, said conveyor comprising:

a core surrounded by a tubular casing defining said cylindrical drum; and a drive for rotating said tubular casing relative to said core, only some of said apertures applying said vacuum at a given time, said application of said vacuum being controlled by rotation of said tubular casing relative to said core.

17. The device according to claim 2, comprising a second conveyor for conveying said band from said storage to said conveyor.

18. The device according to claim 2, said roller being located on a side of said roll opposite said cylindrical drum in said active position.

19. The apparatus of claim 7, said cylindrical drum being configured for progressively releasing said vacuum applied to said band as said band is transferred to said roll on said rotating of said cylindrical drum.

* * * * *